US008050590B2

(12) United States Patent
Parks

(10) Patent No.: US 8,050,590 B2
(45) Date of Patent: Nov. 1, 2011

(54) CORONA DEVICE GRID CLEANER

(75) Inventor: Bruce J Parks, Bloomfield, NY (US)

(73) Assignee: Xerox Corporation, Norwalk, CT (US)

( * ) Notice: Subject to any disclaimer, the term of this patent is extended or adjusted under 35 U.S.C. 154(b) by 574 days.

(21) Appl. No.: 12/198,163

(22) Filed: Aug. 26, 2008

(65) Prior Publication Data

US 2010/0054793 A1 Mar. 4, 2010

(51) Int. Cl.
*G03G 15/02* (2006.01)

(52) U.S. Cl. ..... 399/100; 399/168

(58) Field of Classification Search ..... None
See application file for complete search history.

(56) References Cited

U.S. PATENT DOCUMENTS 7,272,337 B2 9/2007 Owens
2007/0059026 A1 * 3/2007 Owens ..... 399/100

FOREIGN PATENT DOCUMENTS

JP 404042248 A * 2/1992

* cited by examiner

*Primary Examiner* — David Gray
*Assistant Examiner* — Roy Y Yi
(74) *Attorney, Agent, or Firm* — Lloyd F. Bean, II

(57) ABSTRACT

This is a device for cleaning a corona grid used in electrostatic printing or copying machines. This device has a cleaner pad that cleans the outer surface of the grid, that is the surface closest to the photoreceptor surface. This pad is located between the outer surface of the grid and the surface of the photoreceptor. It can be used together with a cleaner pad that cleans the inner surface of the grid.

8 Claims, 7 Drawing Sheets

CORONA DEVICE GRID CLEANER

CROSS-REFERENCE TO RELATED APPLICATIONS

The presently disclosed embodiments are directed generally to a photocopier and more specifically to the corona charging portion of the electrostatic copier.

BACKGROUND

When photocopiers were first used, charging of the photoreceptor or photoconductive plate was usually accomplished by rubbing the photoconductive surface with electronic charging materials, such as rabbit fur. Today much more sophisticated charging means are used; in particular, corona charges. Generally, the corona charger comprises an array of charge emitting pins located in close proximity to a corona grid. The pins emit the charge and convey this charge to a conductive grid, which provides uniformity of charge across the entire used surface of the photoreceptor. The grid is specifically configured so as to have uniform charge emitting capabilities across its entire longitudinal surface. It is especially important to maintain the grid surface in condition where it will provide this uniform charge distribution across the photoreceptor or photoconductive surface. Once a uniform charge is placed by the grid across the photoreceptor surface, the remainder of the imaging process is followed, i.e., exposure of image, dissipation of charge in image configuration, contact with toner and fixing of toner image on a paper or receptive surface.

Contamination of the inner and outer sides of the grid could lead to print quality defects such as streaks, image quality and other performance problems. Examples of image quality failures would be half tone non-uniformities and white and dark streaks in the final image. Also, the life of the corona charging mechanism can be adversely affected if the grid is not kept uniformly clear of contaminants, such as toner.

There are used today various corona cleaning methods and apparatus to remove the toner build up and other contaminates from the grid. Traditionally, these corona cleaning devices have focused on cleaning the pins, wires and inside or inner surface of the corona grid. However, cleaning the grid surface closest to the photoreceptor (outer surface) grid has been neglected. This could be due to concerns about scratching or contacting the photoreceptor surface during any grid cleaning operation. As a result, the corona grid (photoreceptor side) or outside grid surface has not been effectively cleaned of toner build up or other contaminants. Due to this lack of cleaning of the photoreceptor side (outer side) of the grid, a number of image quality problems may result. Also, as noted above, the useful life of the corona device could be shortened if proper grid cleaning is not observed. Typical spacing between the grid and photoreceptor is 1-2 mm, leaving insufficient room for a cleaning device to sweep across the outside grid surface.

SUMMARY

The present disclosed embodiments provide a corona grid cleaning device substantially devoid of the above noted disadvantages. The embodiments described herein provide a corona cleaning device that cleans both sides of the corona grid, the inner side closest to the array of pins, and the outer side closest to the photoreceptor. There is provided a class of scorotron cleaning carriage and mounting designs that are interlocked, such that the scorotron moves between normal operating position when the cleaning carriage is in its home position and a service position further from the photoreceptor when the cleaning carriage leaves its home position. This permits the use of additional brush, foam, or other elements to remove contaminants from the front (photoreceptor-facing) surface of the scorotron grid during the cleaning cycle. In current products this is not done despite the impact of contaminants in this area on charge uniformity, due to the close spacing of grid and photoreceptor This corona grid cleaning assembly comprises in an operative arrangement, at least two cleaner pads, an inner cleaner pad and an outer cleaner pad, an array of charge emitting pins, a corona grid having an inner and an outer surface, and a cleaner transport. The cleaner transport is enabled to move said at least two cleaner pads along both said inner and outer surfaces. The pads are adapted to clean said inner and outer surfaces, together with said array or pins. The inner cleaner pad is adapted to remove toner and other debris from said pins and the inner surface of the corona grid. The outer cleaner pad is adapted to remove toner and other debris from an outer surface of said corona grid, the outer surface being adjacent said photoconductive surface. The cleaner transport moves both the inner cleaner pad and the outer cleaner pad substantially simultaneously with each other.

As earlier noted, the corona cleaning device comprises in operative relationship, an array of charging pins, a grid extending at least through the longitudinal distance of said pins, at least two cleaning pads, and a pad transporting system. The two cleaning pads comprise at least one inner grid cleaning pad and at least one outer grid cleaning pad. The transport system is enabled to move all inner and outer grid cleaning pads at substantially the same time across substantially the entire surface of said grid. The device of claim 7 wherein said inner grid cleaning pad and said outer grid cleaning pad are constructed of a base material selected from the group consisting of fibers, foams and mixtures thereof. This corona cleaning provides that said inner and outer grid cleaning pads are operatively attached to a carriage of the transport system. The transport system is enabled to move said pads along both the inner and outer grid surface to accomplish thereby removal of toner and other contaminates from both sides of said grid. This pad transporting system comprises a helix or screw positioned laterally along a longitudinal portion of said grid and is adapted to move at least two of said cleaning pads along both an inner and an outer surface of said grid.

Therefore, the present corona grid cleaning device comprises a two sided grid, an inner grid cleaning pad, an array of electron emitting pins, an outer grid cleaning pad, and a pad transporting system. The grid has an inner surface adjacent to said array of electron emitting pins. The grid has an outer surface adjacent to a photoreceptor surface. The pad transporting system could comprise a manual transport system, an automatic transport system and mixtures thereof. At least one inner grid cleaning pad is adapted to operatively contact an inner surface of said grid, at least one outer grid cleaning pad is adapted to operatively contact an outer surface of said grid. The outer grid cleaning pad and inner grid cleaning pad are adapted to move along an outer surface of said grid without contacting and damaging said photoreceptor surface. The transport system is enabled to move both said inner grid cleaning pad and said outer grid cleaning pad substantially simultaneously along the inner and outer surfaces of said grid.

In other embodiments, it may be desirable to use an automatic cleaning system where the pad or pads are still movable along these rails but rather than a movable handle, automatic moving apparatuses are used. Conventional motor or other automatic means are used. In one embodiment where an automatic moving or transport cleaner is used, a helix or screw structure is operatively connected to the pad or pads to laterally move them along the grid surface via the rails. The pads can be moved simultaneously by either the manual or automatic moving means.

Some suitable materials used to make the pads include foam and brush materials such as polyester foam or TEFLON® felt that will both physically clean and attract toner electrostatically. In some embodiments, a foam structure may be used for one pad (either outer or inner) and a fiber brush may be used for the other. Obviously, the same structure may be used for both pads. Any other suitable structure may be used for either or both pads.

DETAILED DESCRIPTION

Figure 1:
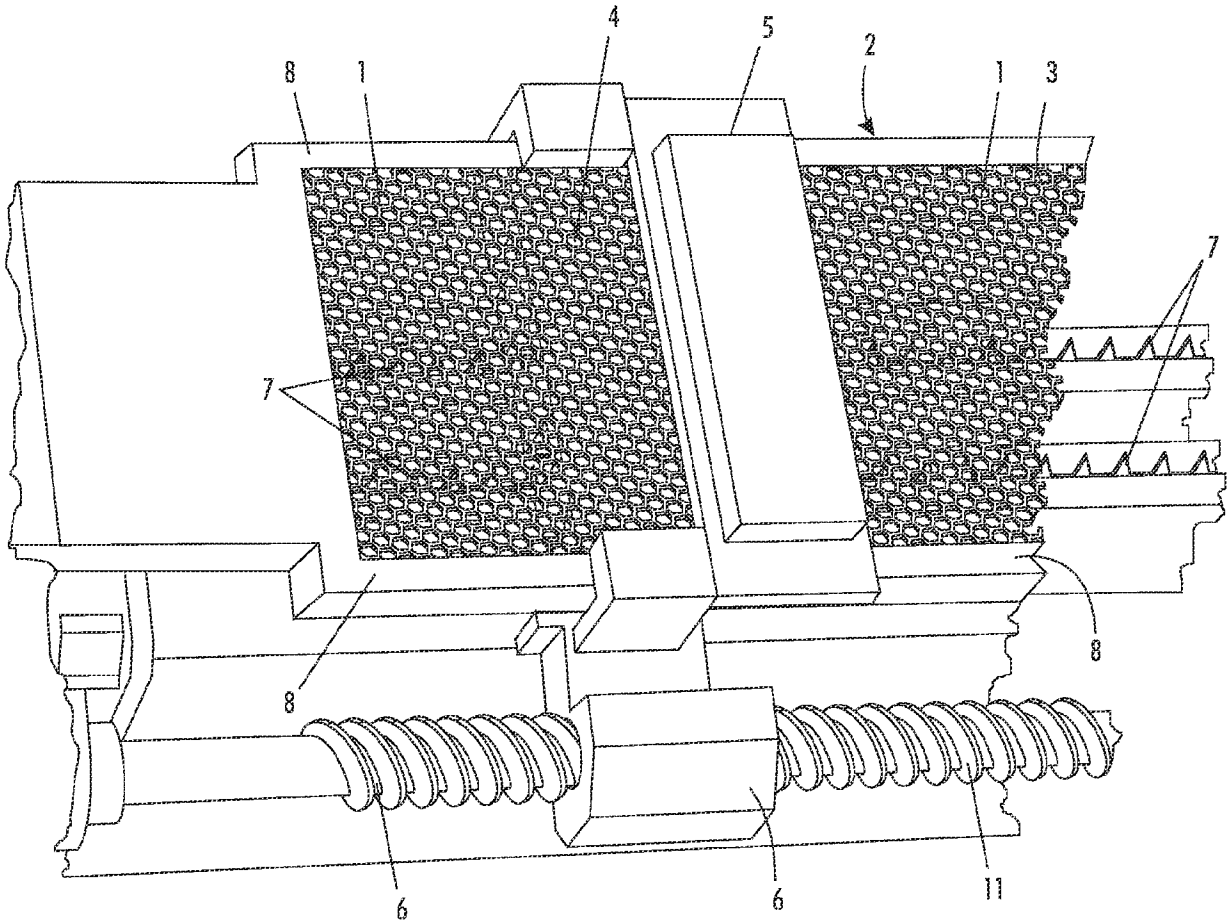
FIG. 1 illustrates an automatic corona two sided grid and pin cleaner of an embodiment of this invention.

In FIG. 1 a two sided automatic grid and pin cleaner is illustrated having a grid 1 having an inner surface 2 and an outer surface 3. There are two grid cleaning pads, inner side cleaner pad 4 and outside cleaner pad 5. An automatic cleaner transport device 6 is provided to move both inner surface cleaner pad 4 and outer surface cleaner pad 5 along the respective surfaces of grid 1. This transport device 6 is a screw or helix which when turned imparts motion to both pads 4 and 5, and causes them to contact and clean grid 1. Obviously, any suitable automatic transport device 6 can be used. Below inner grid surface 2 are positioned an array of charge emitting pins 7. The lower portion of inner grid side cleaner pad 4 contacts and cleans pins 7 whereby the upper portion of inner cleaner pad 4 contacts and cleans the inner grid surface 2. Both the inner cleaner pad 4 and the outer cleaning pad 5 are operatively movably connected to rails 8 where they are slideably movable upon motion impacted by the automatic transport device 6. In this embodiment the inner grid surface 2 and pins 7 are both cleaned by contact of inside or inner cleaner pad 4 and the outer leaner pad 5 cleans the outside or outer grid surface 3 of toner and debris. The drawing in FIG. 1 shows pads 4 and 5 offset from each other; however, they can be superimposed, if desirable, or they can be of any suitable arrangement, as long as transport device 6 moves them in any suitable manner so as to clean both sides of grid 1. The grid cleaner pads 4 and 5 can be made of a woven fiber or foam material or any other suitable material.

Figure 2:
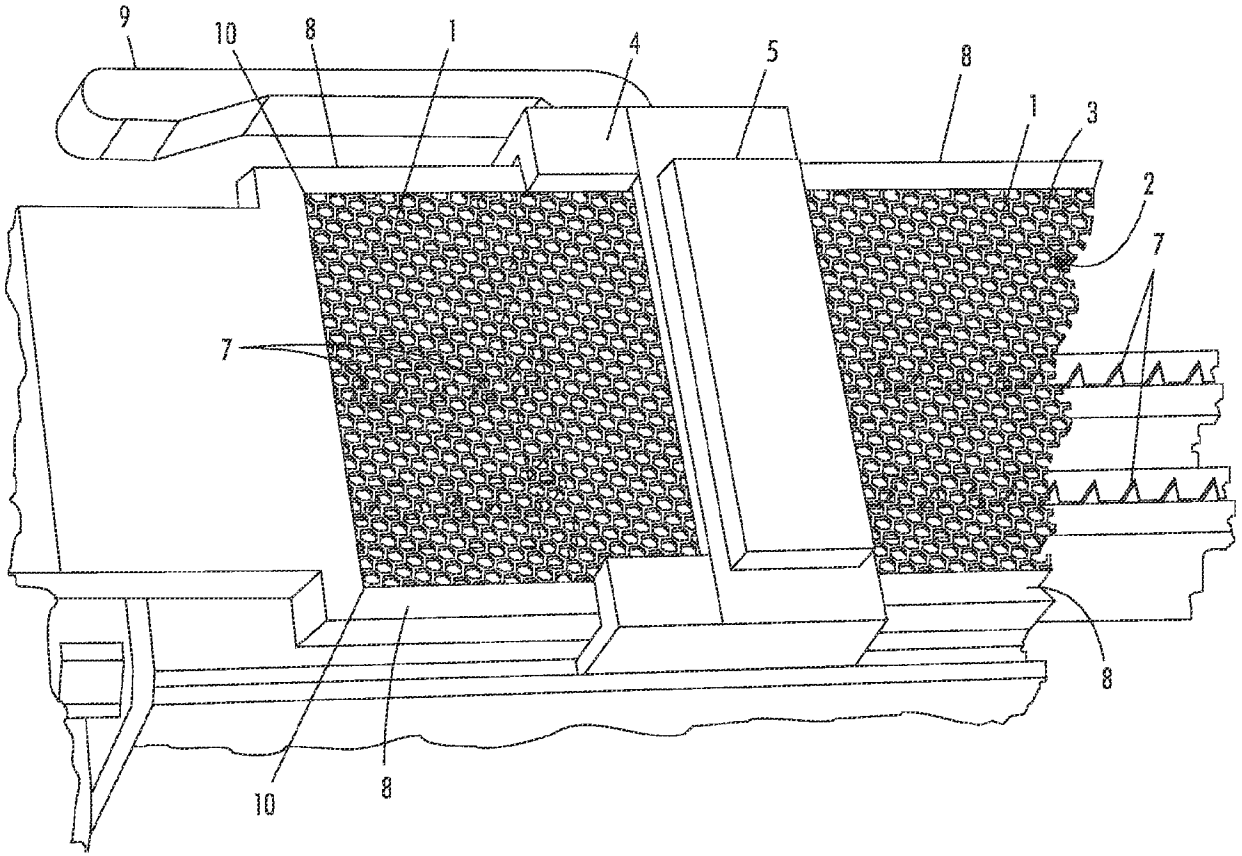
FIG. 2 illustrates a manual corona two sided grid and pin cleaner of an embodiment of this invention.

In FIG. 2 manual (as opposed to automatic) two sided grid and pin cleaner is illustrated. The same components as in FIG. 1 are shown, except a handle 9 is shown in FIG. 2, which is used to move inner pads 4 and outer pad 5 back and forth along rails 8 so as to contact the components to be cleaned. The inner cleaning pad 4 cleans by contacting pins 7 and the inner grid surface 2 of grid 1. The outer cleaning pad cleans by contact the outer grid surface 3. Handle 9 is manually operated by sliding, pushing and/or pulling on rails 8 toward either end 10 of grid 1. Any suitable location for handle 9 is workable, i.e. at end(s) of grid 1. The drawing for clarity shows only one end 10 of grid 1; however, the opposite end of grid 1 is similar to the end 10 shown in the drawings. Pads 4 and 5 operatively abut each other so that operating handle 9 will move both pads substantially, simultaneously. Pads 4 and 5 easily slide along nails 8 for convenient manual cleaning operation of both sides 2 and 3 of grid and pins 7.

Figure 3:
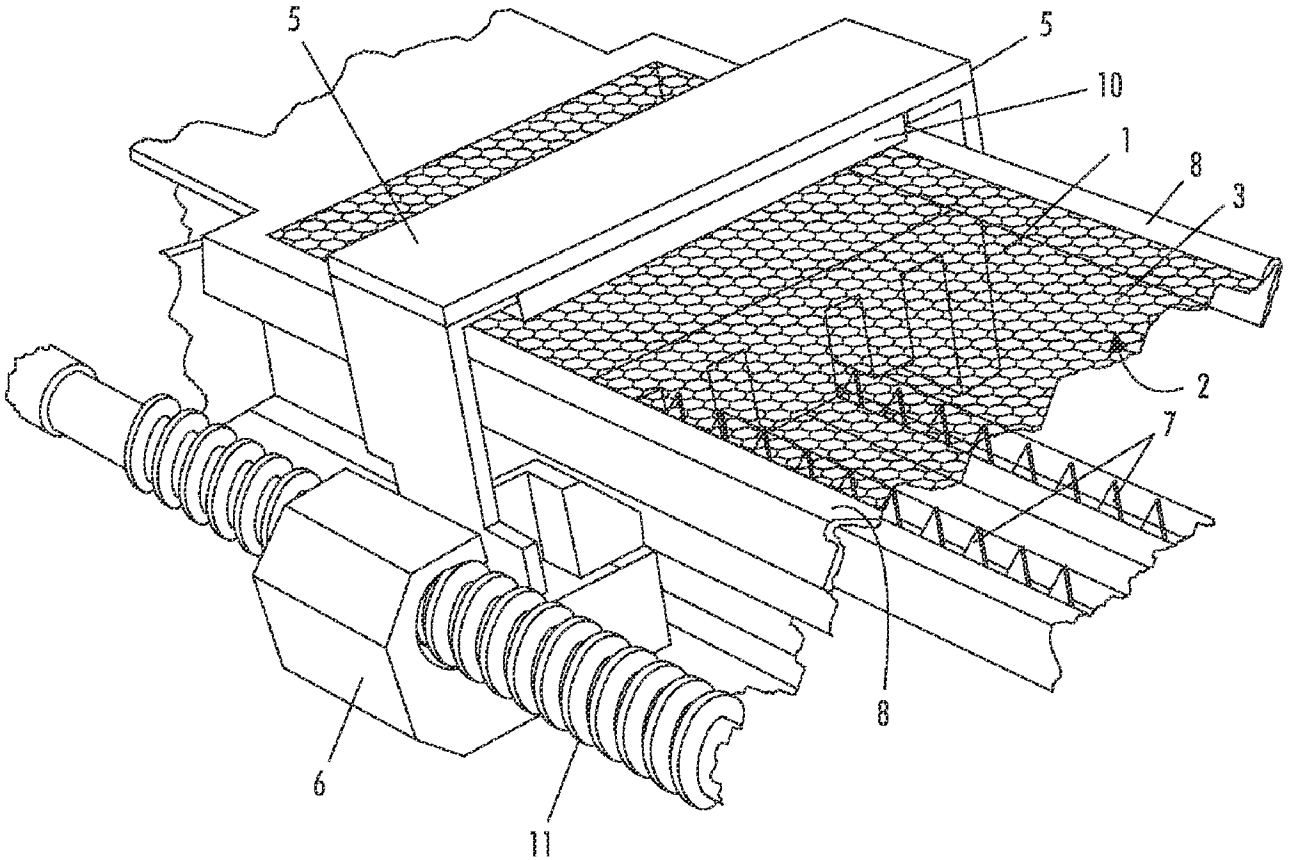
FIG. 3 illustrates an automatic one sided (outside) corona grid cleaner of an embodiment of this invention.

In FIG. 3 an embodiment with an automatic one side (outside) corona grid cleaning system is illustrated. In this drawing grid 1 is cleaned on its outside surface by outside cleaner pad 5. If the outside grid surface 3 is close to a photoreceptor surface, it is desirable to use a thin pad 5, which can be substantially thinner than inside pad 4. In this automatic embodiment of an outside cleaning system, cleaning pad 5 is moved along the outside surface 3 to remove toner and other debris which may have accumulated during frequent operation. As helix or screw 11 on the automatic transport device 6 turns, it impels pad 5 in the direction of the screw's turn.

Figure 4:
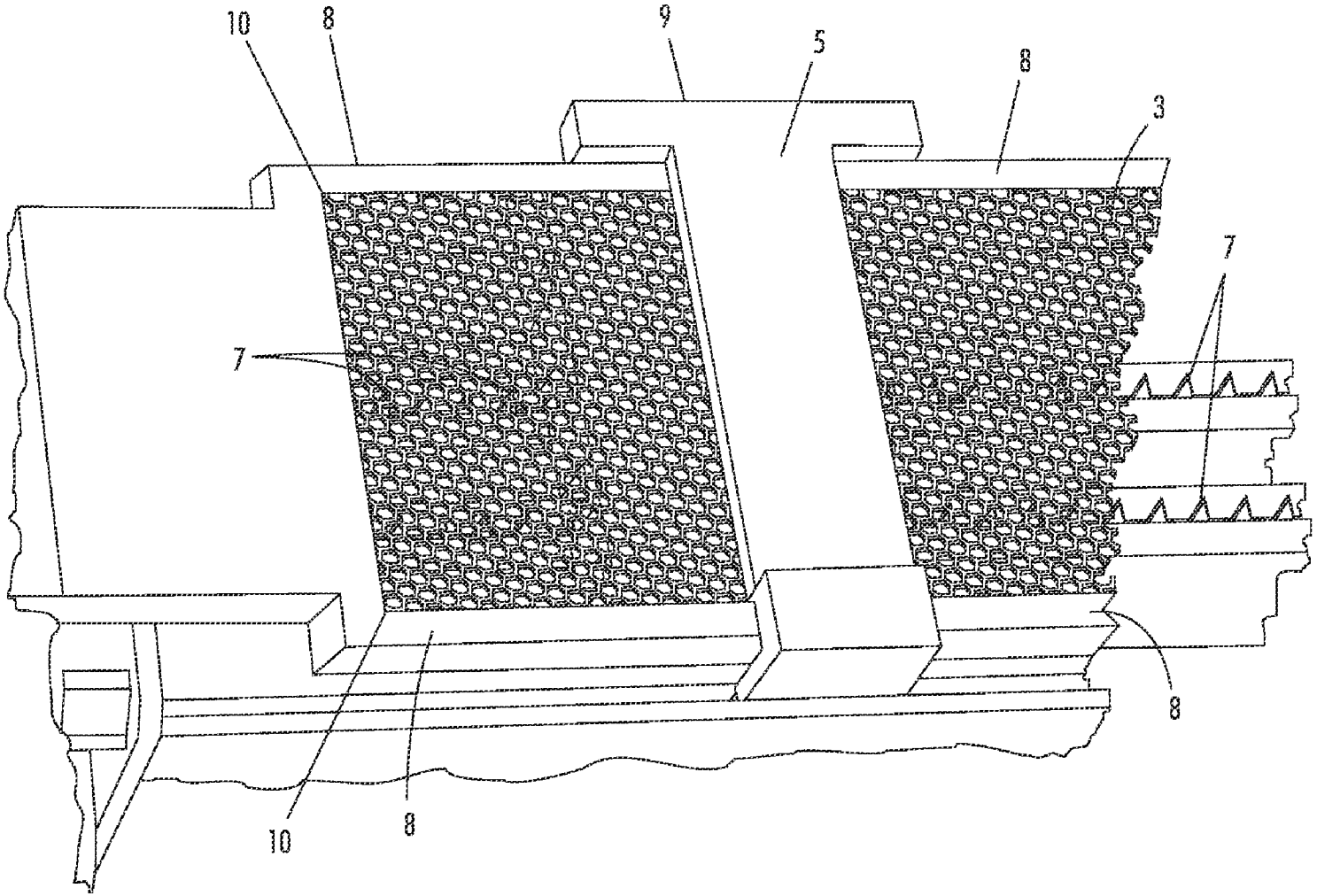
FIG. 4 illustrates a manual one sided (outside) corona grid cleaner of an embodiment of the present system.

In FIG. 4 an embodiment where a manual one sided (outer) corona grid cleaner is shown in operative arrangement with movable handle 9. When only the outside grid surface 3 is desired to be cleaned manually, the embodiment here is used. As earlier noted, a thin pad 5 is conveniently used so as not to contact or damage an adjacent photoreceptor surface (not shown) which is always located next to the outer grid surface 3.

Figure 5:
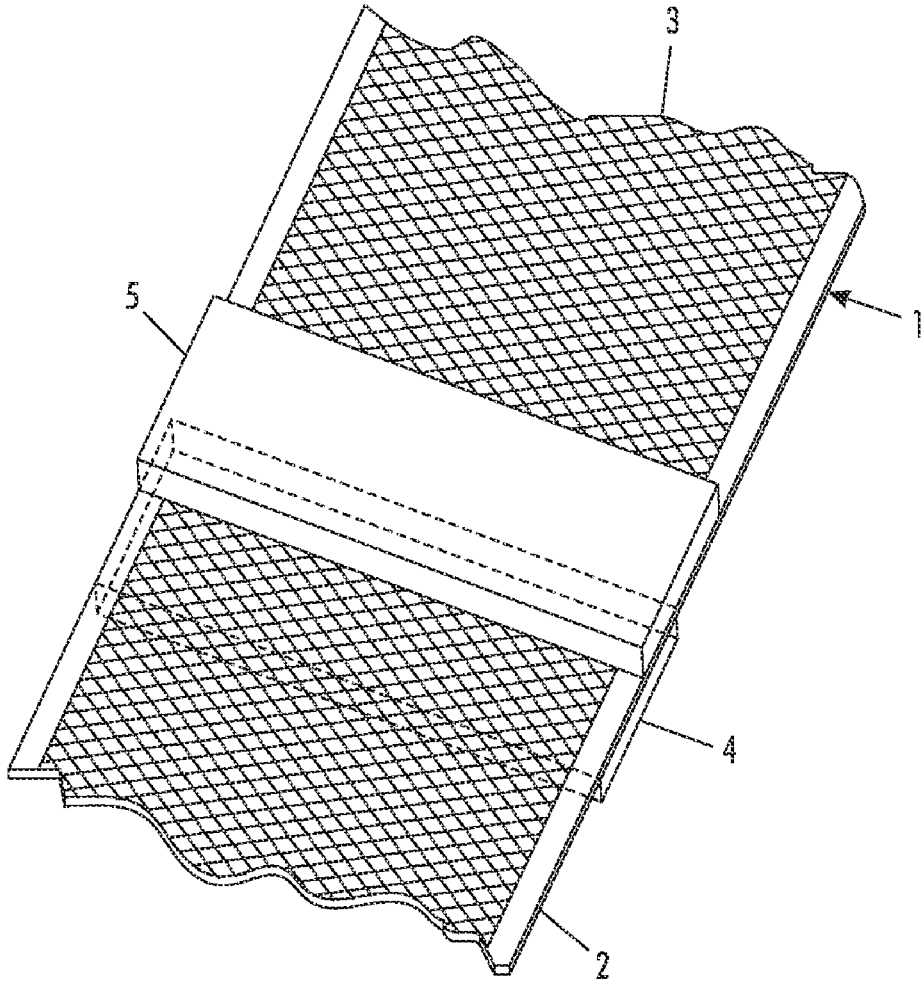
FIG. 5 illustrates a simple embodiment to show a two-sided grid and pin cleaner.

In FIG. 5 a top perspective view of a two-sided grid and pin cleaner is shown simply to show the positions of inner side cleaner pad 4 and outside cleaner pad 5. The transport devices are not shown for clarity. When both pads 4 and 5 are moved (by a suitable transport device) inner surface 2 and outer surface 3 of the grid 1 are cleaned substantially simultaneously. The transport devices for this two-sided grid cleaner can be either automatic or manual. Again, this FIG. 5 is presented in simple form merely to show the positioning of the cleaner pads 4 and 5; all other components such as transport devices, pins, rails, handles, etc. are omitted for clarity.

Figure 6:
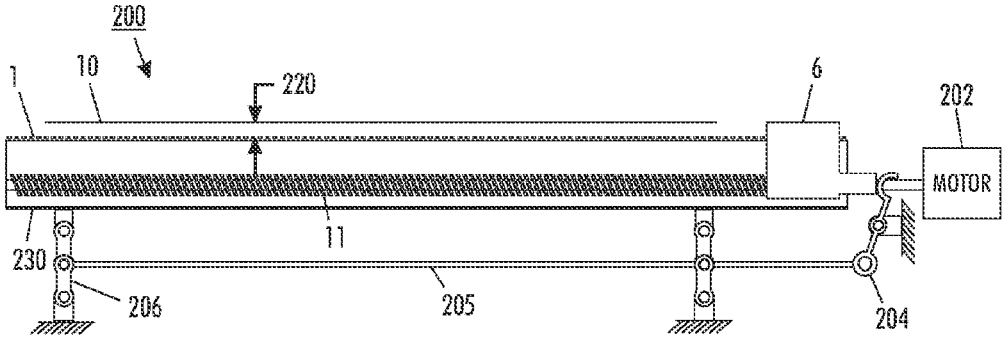
FIGS. 6 and 8 an embodiment where corona grid cleaner is shown in non operative arrangement.
Figure 7:
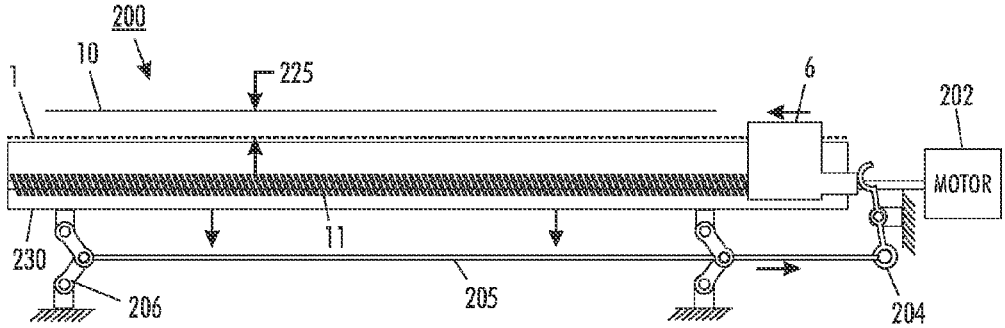
FIGS. 7 and 9 is an embodiment where corona grid cleaner is shown in operative arrangement.
Figure 8:
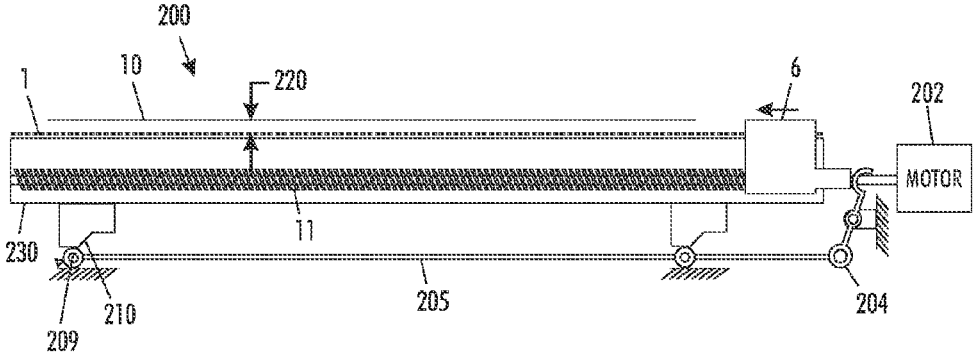
Figure 9:
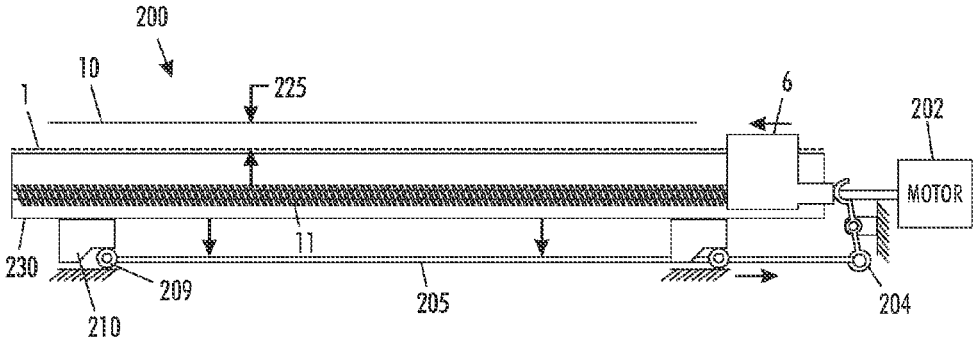

In FIGS. 6 and 8 an embodiment where corona grid cleaner is shown in non operative arrangement while FIGS. 7 and 9 is an embodiment where corona grid cleaner is shown in operative arrangement. Retractable assembly 200 is adapted to translate the charging device 230 in relation to photoreceptor 10 from an operating position 220 to a cleaning position 225. Transport device 6 coacts with retractable assembly 200 to translate charging device 230 in relation to photoreceptor 10 surface from operating position 220 to cleaning position 225. Retractable assembly 200 includes a lever arm member 204 connected to positioning rod 205 includes when lever arm 204 engages transport device 6. Retractable assembly 200 retracts to operating position 220. Transport device 6 disengages with lever arm 204, retractable assembly 200 moves to cleaning position 225. While retractable assembly 200 is illustrated as a scissor linkage assembly with positioning linkage 206 are shown in FIGS. 6 and 7, or a ramp and roller assembly with positioning ramp 210 and roller 209 as shown in FIGS. 8 and 9. Obviously, any suitable retractable assembly device can be used.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art, which are also intended to be encompassed by the following claims.

What is claimed is:

1. A charging device for charging an imageable surface, said charging device including an array of electron emitting pins, a grid said grid having an inner surface adjacent to said array of electron emitting pins and grid having an outer surface adjacent to a photoreceptor surface, said charging device further including a corona grid cleaning device which comprises: an inner grid cleaning pad, an outer grid cleaning pad, a pad transporting system, and a mounting assembly adapted to translate said charging device in relation to said imageable surface from an operating position to a cleaning position, said pad transporting system coacts with said mounting assembly to translate said charging device in relation to said imageable surface from said operating position to said cleaning position, said mounting assembly includes a retractable assembly and a lever arm member connected to said retractable assembly, said lever arm when engaged by said pad transporting system retracts said mounting assembly to said operating position and when disengaged with said lever arm said mounting assembly moves to said cleaning position.

2. The device of claim 1 wherein said retractable assembly includes a scissor linkage assembly.

3. The device of claim 1 wherein said retractable assembly includes a ramp and roller assembly.

4. The device of claim 1 further including an automatic system comprises a screw or helix which upon activation will move said outer cleaning pad and said inner cleaning pad along both sides of said grid.

5. The device of claim 1 wherein said inner grid cleaning pad is adapted to clean said electron emitting pins and said inner surface of said grid.

6. The device of claim 1 wherein said inner and outer grid cleaning pads are operatively attached to rails and a carriage of said transporting system.

7. The device of claim 1 wherein said transporting system is enabled to move said pads along substantially both the total inner and outer grid surfaces and adapted to thereby remove contaminants from both sides of said grid.

8. The device of claim 1 wherein said inner grid cleaning pad and said outer grid cleaning pad are constructed of a structure selected from the group consisting of fibers, foams and mixtures thereof.

* * * * *